US008113320B2

(12) United States Patent
Kawai et al.

(10) Patent No.: US 8,113,320 B2
(45) Date of Patent: Feb. 14, 2012

(54) FIRE EVACUATION SUPPORT SYSTEM AND FIRE DOOR CONTROL DEVICE

(75) Inventors: Kiyoji Kawai, Tokyo (JP); Masahiko Konishi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 439 days.

(21) Appl. No.: 12/519,176

(22) PCT Filed: Dec. 15, 2006

(86) PCT No.: PCT/JP2006/325067

§ 371 (c)(1),
(2), (4) Date: Jun. 15, 2009

(87) PCT Pub. No.: WO2008/072344

PCT Pub. Date: Jun. 19, 2008

(65) Prior Publication Data

US 2009/0321190 A1 Dec. 31, 2009

(51) Int. Cl.
*B66B 1/20* (2006.01)

(52) U.S. Cl. ..... 187/384; 187/314; 187/391

(58) Field of Classification Search ..... 187/313, 187/314, 316, 317, 380–388, 391–393, 396
See application file for complete search history.

(56) References Cited

U.S. PATENT DOCUMENTS 4,023,146 A * 5/1977 Carroll ..... 710/113
5,979,607 A 11/1999 Allen
6,000,505 A * 12/1999 Allen ..... 187/391
7,182,174 B2 * 2/2007 Parrini et al. ..... 182/18
7,621,378 B2 * 11/2009 Kawai ..... 187/313
7,637,354 B2 * 12/2009 Kawai ..... 187/313

(Continued)

FOREIGN PATENT DOCUMENTS

JP 54 20555 2/1979

(Continued)

OTHER PUBLICATIONS

Chinese Office Action dated May 9, 2011, in Chinese Application No. 200680056635.7.

(Continued)

*Primary Examiner* — Anthony Salata
(74) *Attorney, Agent, or Firm* — Oblon, Spivak, McClelland, Maier & Neustadt, L.L.P.

(57) ABSTRACT

Provided, on each floor of a building, are an elevator installation zone, in which an elevator is installed, a neighboring zone which neighbors the elevator installation zone, and is in communication with the elevator installation zone through a first communication port, and an external zone which is in communication with the neighboring zone through a second communication port different from the first communication port. The first communication port is opened and closed by a first fire door, and the second communication port is opened and closed by a second fire door. A fire evacuation support system manages an operation of the elevator based on information from a plurality of fire detectors provided on each floor when a fire occurs in the building. Further, the fire evacuation support system includes an evacuation operation command section in which implementation of an evacuation operation for transporting a person left in the building to an evacuation floor is allowed for the elevator when contamination due to the fire is avoided in both the elevator installation zone and the neighboring zone, and in which the implementation of the evacuation operation is stopped when at least anyone of the elevator installation zone and the neighboring zone is contaminated due to the fire.

4 Claims, 3 Drawing Sheets

U.S. PATENT DOCUMENTS

| | | | | |
|---|---|---|---|---|
| 7,743,889 | B2 * | 6/2010 | Kawai | 187/313 |
| 7,849,973 | B2 * | 12/2010 | Hikita et al. | 187/384 |
| 7,938,232 | B2 * | 5/2011 | Hikita et al. | 187/384 |
| 7,954,603 | B2 * | 6/2011 | Hikita et al. | 187/284 |
| 2007/0278044 | A1 | 12/2007 | Hikita et al. | |
| 2009/0127030 | A1 | 5/2009 | Hikita et al. | |
| 2009/0314587 | A1 * | 12/2009 | Kawai et al. | 187/314 |

FOREIGN PATENT DOCUMENTS

| | | |
|---|---|---|
| JP | 60 198164 | 10/1985 |
| JP | 2 74268 | 3/1990 |
| JP | 7 100222 | 4/1995 |
| JP | 2003 199839 | 7/2003 |
| JP | 2004 155575 | 6/2004 |

OTHER PUBLICATIONS

Sekizawa, A. et al., "Study on Feasibility of Evacuation Using Elevators in a High-Rise Building (Part. 2)—Examination From the Viewpoint of Transportation Efficiency-", pp. 590-593 (2004) (with English abstract).

* cited by examiner

FIRE EVACUATION SUPPORT SYSTEM AND FIRE DOOR CONTROL DEVICE

TECHNICAL FIELD

The present invention relates to a fire evacuation support system and a fire door control device, for evacuating a person left in a building when a fire occurs in the building.

BACKGROUND ART

Conventionally, a fire control operation system for an elevator for rescuing a person left in a building to an evacuation floor upon operation of a fire detector installed in the building, has been proposed. In the conventional fire control operation system for the elevator, an evacuation time until fire or smoke reaches an elevator hall is pre-calculated based on information from the fire detector. Then, a rescue operation of the elevator for rescuing the left person is performed within the range of the pre-calculated evacuation time. Therefore, the rescue operation of the elevator is sometimes performed until the fire or the smoke reaches the elevator hall (see Patent Document 1).

Patent Document 1: WO 2004/101418

DISCLOSURE OF THE INVENTION

Problem to be Solved by the Invention

If the evacuation operation is continued until the elevator hall is contaminated by a flame or the smoke, however, a risk of occurrence of a sudden failure of the elevator during the evacuation operation due to, for example, the flame or water used for fire fighting becomes higher. Therefore, in order to prevent the rescue operation from being stopped for the failure (abnormality) of the elevator, each of fire prevention, smoke-proof, and water-proof measures is required to be taken for the elevator, disadvantageously resulting in an increase in cost.

The present invention has been made in order to solve the problem described above, and has an object to obtain a fire evacuation support system and a fire door control device, which are capable of preventing an operation from being stopped for abnormality of an elevator and of preventing an increase in cost.

Means for Solving the Problems

A fire evacuation support system manages an operation of an elevator based on information from a plurality of fire detectors provided on each of a plurality of floors when a fire occurs in a building. The building includes, on each of the plurality of floors, an elevator installation zone in which the elevator is installed, a neighboring zone neighboring the elevator installation zone, the neighboring zone being in communication with the elevator installation zone through a first communication port, and an external zone in communication with the neighboring zone through a second communication port different from the first communication port, the first communication port being opened and closed by a first fire door, and the second communication port being opened and closed by a second fire door. The fire evacuation support system includes: an evacuation operation command section in which implementation of an evacuation operation for transporting a person left in the building to an evacuation floor is allowed for the elevator when contamination due to the fire is avoided in both the elevator installation zone and the neighboring zone, and in which the implementation of the evacuation operation is stopped when at least any one of the elevator installation zone and the neighboring zone is contaminated due to the fire.

A fire door control device controls an operation of each of a first fire door for opening and closing a first communication port and a second fire door for opening and closing a second communication port different from the first communication port based on information from a plurality of fire detectors provided on each of a plurality of floors of a building when a fire occurs in the building including, on each of the plurality of floors, an elevator installation zone in which an elevator is installed, a neighboring zone neighboring the elevator installation zone, the neighboring zone being in communication with the elevator installation zone through the first communication port, and an external zone in communication with the neighboring zone through the second communication port. The fire door control device causes each of the first fire door and the second fire door provided on an operation target floor preset to correspond to a fire occurrence floor on which the fire detector has detected contamination due to the fire, among the first fire doors and the second fire doors provided on the plurality of floors, to operate in conjunction with a detection of the fire by the fire detector on the fire occurrence floor to close each of the first communication port and the second communication port.

Effects of the Invention

In the evacuation control system using the elevator according to the present invention, it is judged whether or not the evacuation operation of the elevator can be performed based on the presence/absence of the contamination due to the fire in each of the elevator installation zone, the neighboring zone, and the external zone. The implementation of the evacuation operation is stopped when at least any one of the elevator installation zone and the neighboring zone is contaminated due to the fire. Therefore, the evacuation operation of the elevator can be normally terminated before the contamination due to the fire reaches the elevator installation zone from the neighboring zone. Accordingly, the evacuation operation can be prevented from being stopped for the abnormality of the elevator. Moreover, it is no longer necessary to take excessive fire-prevention, smoke-proof, and water-proof measures, and hence it is also possible to prevent an increase in cost.

In the fire door control device according to the present invention, each of the first fire door and the second fire door, which are provided on the operation target floor preset to correspond to the fire occurrence floor on which the fire detector has detected the contamination due to the fire, is operated in conjunction with the detection of the fire by the fire detector on the fire occurrence floor to close each of the first communication port and the second communication port. Therefore, it can be further ensured that the flame or the smoke is delayed in reaching the elevator installation zone and the neighboring zone. As a result, when the elevator performs the evacuation operation, the evacuation operation can be prevented from being stopped for the abnormality of the elevator. Moreover, it is no longer necessary to take excessive fire-prevention, smoke-proof, and water-proof measures, and hence it is also possible to prevent the increase in cost.

BEST MODE FOR CARRYING OUT THE INVENTION

Figure 1:
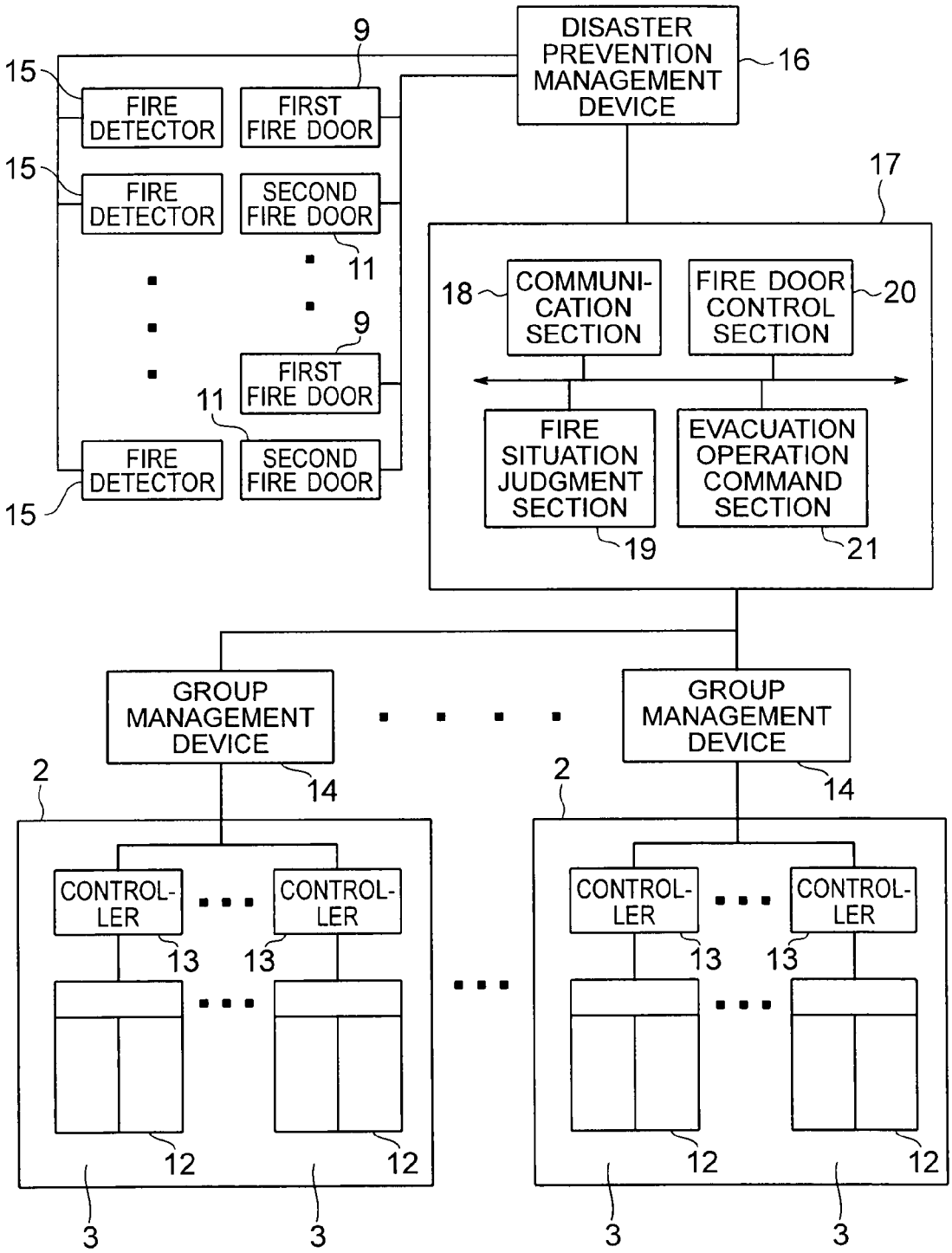
FIG. 1 is a block diagram illustrating a fire evacuation support system according to a first embodiment of the present invention.

Hereinafter, a preferred embodiment of the present invention is described referring to the drawings.

First Embodiment

Figure 2:
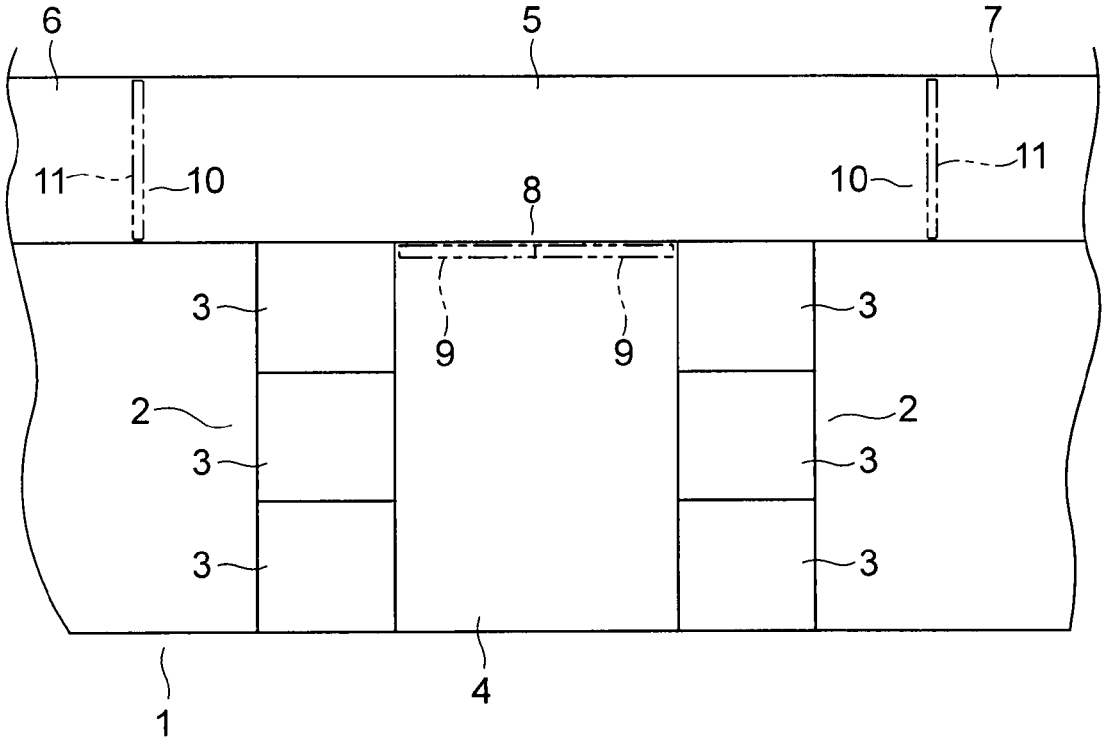
FIG. 2 is a plan view illustrating a building provided with an elevator illustrated in FIG. 1.

FIG. 1 is a block diagram illustrating afire evacuation support system according to a first embodiment of the present invention. FIG. 2 is a plan view illustrating a building provided with an elevator illustrated in FIG. 1. In the figures, in a building 1, a plurality of elevator groups 2 are provided. Each of the elevator groups 2 includes a plurality of elevators 3.

On each floor of the building 1, a common landing (elevator hall), in which each of the elevators 3 is installed, and a passage adjacent to the landing are provided. The landing corresponds to an elevator installation zone 4. The passage is divided into a neighboring zone 5 which neighbors the elevator installation zone 4, and two external zones 6 and 7, each neighboring the neighboring zone 5 and being apart from the elevator installation zone 4 (FIG. 2).

The neighboring zone 5 is in communication with the elevator installation zone 4 through a first communication port 8. First fire doors 9 for opening and closing the first communication port 8 are provided between the elevator installation zone 4 and the neighboring zone 5. Each of the external zones 6 and 7 is in communication with the neighboring zone 5 through second communication ports 10 which are different from the first communication port 8. Second fire doors 11 for opening and closing the second communication ports 10 are provided between the neighboring zone 5 and the external zone 6 and between the neighboring zone 5 and the external zone 7, respectively (FIG. 2). Therefore, each of the elevator installation zone 4 and the neighboring zone 5 is a fire-prevention zone which can be partitioned by the fire doors.

The neighboring zone 5 has a predetermined size surrounding the first communication port 8. A distance from the first communication port 8 to each of the second communication ports 10 is determined not to exceed a preset predetermined distance (for example, 10 m or the like). Specifically, each of the second communication ports 10 is provided within the range from the first communication port 8 to a position which is away therefrom by the predetermined distance.

In the building 1, an emergency stairway (not shown) for allowing a person present in the building 1 to move between the floors is provided to neighbor the passage. In this example, among all the floors of the building 1, a ground floor corresponding to an entrance floor serves as an evacuation floor.

As illustrated in FIG. 1, each of the elevators 3 includes a car 12 which can stop at each of the floors and a controller 13 for controlling a travel of the car 12. The respective operations of the elevators 3 are collectively managed by a group management device 14 for each of the elevator groups 2.

On each of the floors, a plurality of fire detectors 15 for detecting the contamination by a flame, smoke, or the like due to a fire are provided. The fire detectors 15 on each of the floors are provided in the elevator installation zone 4, the neighboring zone 5, and the external zones 6 and 7, respectively. Information from each of the fire detectors 15 is transmitted to a disaster prevention management device 16 for collectively managing the disaster prevention devices in the entire building 1. The disaster prevention management device 16 detects whether or not the fire has occurred based on the information from each of the fire detectors 15. The disaster prevention management device 16 generates a signal according to the position of the fire detector 15 which has detected the contamination due to the fire.

The information from the disaster prevention management device 16 is transmitted to an evacuation support device 17 for collectively managing the group management devices 14 in case of fire. Specifically, the information from each of the fire detectors 15 is transmitted to the evacuation support device 17 through the disaster prevention management device 16. The evacuation support device 17 causes each of the elevators 3 to perform an evacuation operation for transporting the person present in the building from each of the floors to the evacuation floor after the occurrence of the fire is detected by the disaster prevention management device 16.

The evacuation support device 17 includes a communication section 18, a fire situation judgment section 19, a fire door control section (fire door control device) 20, and an evacuation operation command section 21.

The communication section 18 performs information communication between each of the group management devices 14 and the disaster prevention management device 16, and the evacuation support device 17.

The fire situation judgment section 19 judges the presence/absence of the contamination due to the fire for each of the elevator installation zone 4, the neighboring zone 5, and the external zones 6 and 7 based on the information obtained from each of the fire detectors 15 through the disaster prevention management device 16. The judgment of the presence/absence of the contamination due to the fire for each of the elevator installation zone 4, the neighboring zone 5, and the external zones 6 and 7 is performed based on whether or not the fire detectors 15 respectively provided in the zones 4 to 7 have detected the contamination due to the fire.

The fire door control section 20 controls the respective operations of the first fire doors 9 and the second fire doors 11 based on information from the fire situation judgment section 19. Specifically, when at least any one of the fire detectors 15 provided on each of the floors detects the contamination due to the fire, the fire door control section 20 causes the first fire doors 9 and the second fire doors 11, which are provided on the floor on which the fire detector 15 detects the contamination due to the fire (fire occurrence floor) and on the floor situated directly above the fire occurrence floor (floor directly above the fire), to perform a door closing operation regardless of the presence/absence of the contamination due to the fire in the elevator installation zone 4, the neighboring zone 5, and the external zones 6 and 7. As a result, the first communication port 8 and the second communication ports 10 on each of the fire occurrence floor and the floor directly above the fire are closed. The door closing operation of each of the first fire doors 9 and the second fire doors 11 is performed in conjunction with the detection of the contamination due to the fire by the fire detector 15 on the fire occurrence floor. Specifically, in this example, the fire occurrence floor and the floor directly above the fire are preset as operation target floors, each being provided with the first fire doors 9 and the second fire doors 11 operating in conjunction with the detection of the fire by the fire detector 15 on the fire occurrence floor.

The evacuation operation command section 21 judges whether or not the evacuation operation of the elevator 3 can be implemented based on the information from the fire situation judgment section 19. Specifically, the evacuation operation command section 21 judges that the evacuation operation can be implemented when the contamination due to the fire is avoided in both the elevator installation zone 4 and the neighboring zone 5, and judges that the evacuation operation cannot be implemented when at least any one of the elevator installation zone 4 and the neighboring zone 5 is contaminated due to the fire.

The evacuation operation command section 21 also outputs a command of the evacuation operation to each of the group management devices 14 when the evacuation operation can be implemented, and stops the output of the command of the evacuation operation when the evacuation operation can no longer be implemented. Upon reception of the command of the evacuation operation from the evacuation operation command section 21, each of the group management devices 14 manages each of the elevators 3 to perform the evacuation operation.

Specifically, the evacuation operation command section 21 allows each of the elevators 3 to implement the evacuation operation only when the contamination due to the fire is avoided in both the elevator installation zone 4 and the neighboring zone 5. The evacuation operation command section 21 stops the implementation of the evacuation operation of each of the elevators 3 when at least any one of the elevator installation zone 4 and the neighboring zone 5 is contaminated due to the fire. The evacuation operation is performed by creating an evacuation operation plan including a floor at which the car 12 is stopped, a time required for the car 12 to stop at the floor, and the like based on the information from the fire situation judgment section 19 and then moving the car 12 based on the thus created evacuation operation plan.

The evacuation support device 17 is constituted by a computer including an arithmetic processing section (CPU), a storage section (ROM, RAM, or the like) and a signal input/output section. The functions of the communication section 18, the fire situation judgment section 19, the fire door control section 20, and the evacuation operation command section 21 are realized by the computer of the evacuation support device 17.

Specifically, in the storage section of the computer, a program for realizing the functions of the communication section 18, the fire situation judgment section 19, the fire door control section 20, and the evacuation operation command section 21 is stored. The arithmetic processing section executes arithmetic processing regarding the functions of the evacuation support device 17 based on the program stored in the storage section.

Next, an operation is described. When the occurrence of the fire is detected by the disaster prevention management device 16, information of determination of the occurrence of the fire, including information of the position of the fire detector 15 which has detected the fire, is transmitted from the disaster prevention management device 16 to the evacuation support device 17. When the evacuation support device 17 receives the information from the disaster prevention management device 16, the fire situation judgment section 19 judges the presence/absence of the contamination due to the fire for each of the elevator installation zone 4, the neighboring zone 5, and the external zones 6 and 7 on each floor.

When neither the elevator installation zone 4 nor the neighboring zone 5 is contaminated, the command of the evacuation operation is output from the evacuation operation command section 21 to each of the group management devices 14 to start the evacuation operation of each of the elevators 3. When at least any one of the elevator installation zone 4 and the neighboring zone 5 is contaminated, the operation of each of the elevators 3 is stopped without implementing the evacuation operation.

Figure 3:
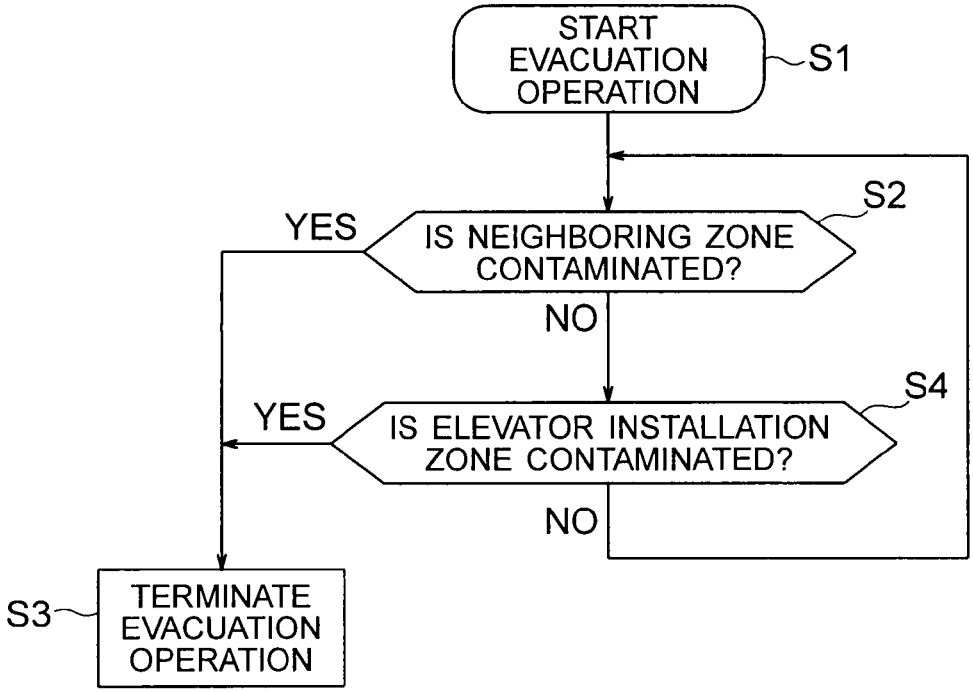
FIG. 3 is a flowchart for illustrating the operation of processing after the start of the evacuation operation by the evacuation operation command section illustrated in FIG. 1.

Next, an operation of processing after the start of the evacuation operation is described. FIG. 3 is a flowchart for illustrating the operation of processing after the start of the evacuation operation by the evacuation operation command section 21 illustrated in FIG. 1. As illustrated in FIG. 3, upon start of the evacuation operation (S1), whether or not the neighboring zone 5 is contaminated due to the fire is judged by the fire situation judgment section 19 (S2). When the neighboring zone 5 is contaminated, the output of the command of the evacuation operation from the evacuation operation command section 21 is stopped to terminate the evacuation operation (S3).

When the neighboring zone 5 is not contaminated, whether or not the elevator installation zone 4 is contaminated due to the fire is then judged by the fire situation judgment section 19 (S4). When the elevator installation zone 4 is contaminated, the output of the command of the evacuation operation from the evacuation operation command section 21 is stopped to terminate the evacuation operation (S3). When the elevator installation zone 4 is not contaminated, the evacuation operation is continued and the presence/absence of the contamination due to the fire in the neighboring zone 5 and the elevator installation zone 4 is repeatedly judged by the fire situation judgment section 19.

Figure 4:
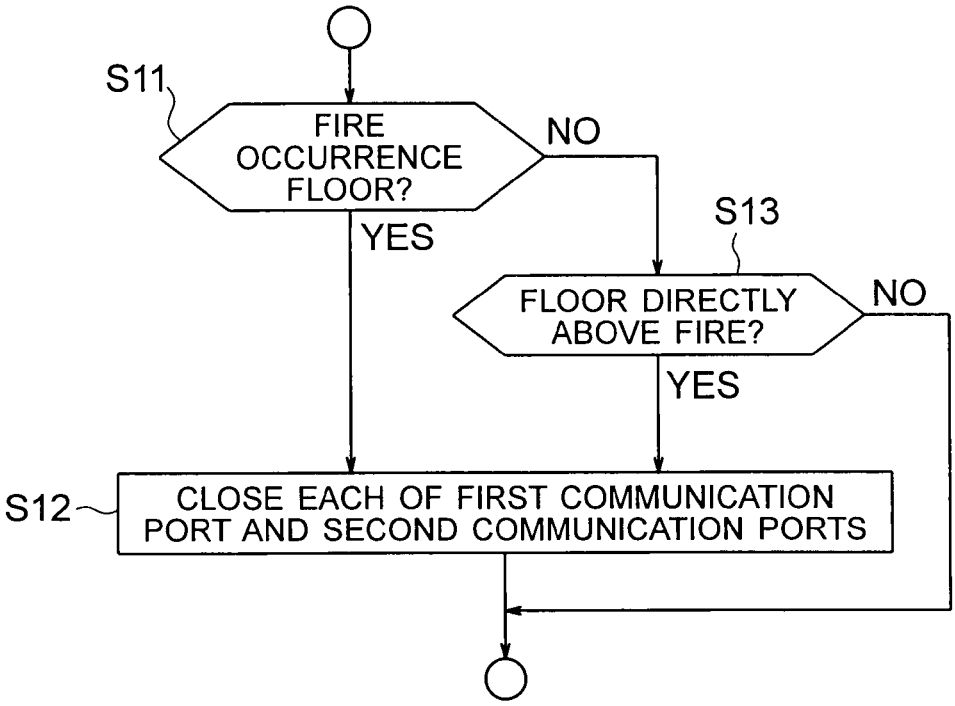
FIG. 4 is a flowchart for illustrating the operation of processing performed by the fire door control section illustrated in FIG. 1.

Next, an operation of processing performed by the fire door control section 20 is described. FIG. 4 is a flowchart for illustrating the operation of processing performed by the fire door control section 20 illustrated in FIG. 1. As illustrated in FIG. 4, the information of the determination of occurrence of the fire from the disaster prevention management device 16 is transmitted to the evacuation support device 17, and the presence/absence of the contamination due to the fire on each of the floors is judged by the fire situation judgment section 19. Then, the fire door control section 20 judges whether or not each of the floors is the fire occurrence floor based on the information from the fire situation judgment section 19 (S11).

When the floor corresponds to the fire occurrence floor, the door closing operation is performed for each of the first fire doors 9 and the second fire doors 11 provided on the fire occurrence floor by the control of the fire door control section 20 to close each of the fire communication port 8 and the second communication ports 10 (S12).

When the floor does not correspond to the fire occurrence floor, it is judged by the fire door control section 20 whether or not the floor is the floor directly above the fire (S13). When the floor corresponds to the floor directly above the fire, the door closing operation is performed for each of the first fire doors 9 and the second fire doors 11 provided on the floor directly above the fire by the control of the fire door control section 20 to close each of the fire communication port 8 and the second communication ports 10 (S12). When the floor does not correspond even to the floor directly above the fire, the door closing operation is not performed for the first fire doors 9 and the second fire doors 11 provided on the floor. Therefore, each of the first communication port 8 and the second communication ports 10 is left open.

In the fire evacuation support system described above, it is judged whether or not the evacuation operation of the elevator 3 can be performed based on the presence/absence of the contamination due to the fire in each of the elevator installation zone 4, the neighboring zone 5, and the external zones 6 and 7. Then, when at least any one of the elevator installation zone 4 and the neighboring zone 5 is contaminated due to the fire, the implementation of the evacuation operation of the elevator 3 is stopped. Therefore, the evacuation operation of the elevator 3 can be normally terminated before the contamination due to the fire reaches the elevator installation zone 4 from the neighboring zone 5. Therefore, the risk of a failure of each of the elevators 3 due to, for example, the flame or the water used for fire fighting can be kept low, thereby preventing the evacuation operation from being stopped for the abnormality of the elevator 3. Moreover, excessive fire-prevention, smoke-proof, and water-proof measures are no longer required, and hence it is also possible to prevent the increase in cost.

Moreover, the operation of each of the first fire doors 9 and the second fire doors 11 is controlled by the fire door control section 20 based on the information from each of the fire detectors 15, and hence the person present in the building is not required to manually move the first fire doors 9 and the second fire doors 11. As a result, the flame or the smoke can be easily and effectively delayed in reaching the elevator installation zone 4 and the neighboring zone 5. Therefore, an implementation time of the evacuation operation of each of the elevators 3 can be further increased.

Further, among the first fire doors 9 and the second fire doors 11 provided on all the floors, the first fire doors 9 and the second fire doors 11 provided on the fire occurrence floor and the floor directly above the fire are operated in conjunction with the detection of the fire by the fire detector 15 on the fire occurrence floor to close each of the first communication port 8 and the second communication ports 10. Therefore, it can be further ensured that the flame or the smoke is delayed in reaching the elevator installation zone 4 and the neighboring zone 5. As a result, the evacuation operation can be prevented from being stopped for the abnormality of the elevator 3. Moreover, excessive fire-prevention, smoke-proof, and water-proof measures are no longer required, and hence it is also possible to prevent the increase in cost.

While the fire door control section 20 is included in the evacuation support device 17 in the example described above, the fire door control section 20 may be mounted in the disaster prevention management device 16.

While the landing of the elevator 3 corresponds to the elevator installation zone 4 in the example described above, the elevator installation zone 4 may be any zone as long as the elevator 3 is installed therein, and therefore, may be, for example, a machine room provided in an upper part of the elevator 3, an electric room in which an electrical wiring of the elevator 3 is installed, or the like. In this case, the neighboring zone 5 is provided to neighbor the machine room or the electric room of the elevator 3.

Further, while the floors, each being provided with the first fire doors 9 and the second fire doors 11 operating in conjunction with the operation of the fire detector 15 upon detection of the contamination due to the fire occurring on the fire occurrence floor, are the fire occurrence floor and the floor directly above the fire in the example described above, such floors are not limited thereto. The floors as described above may be the fire occurrence floor and a floor situated directly below the fire occurrence floor (floor directly below the fire), or may also be the fire occurrence floor, the floor directly above the fire, and the floor directly below the fire. In this case, the floors, each being provided with the first fire doors 9 and the second fire doors 11 operating in conjunction, are set by determining the fire occurrence floor, the floor directly above the fire, the floor directly below the fire, or the like as the operation target floors. The operation target floor is a floor with a high risk of occurrence of the failure of each of the elevators 3 caused by the contamination due to the fire.

Further, while each of the first fire doors 9 and the second fire doors 11 is operated by the control of the fire door control section 20 regardless of the presence/absence of the contamination due to the fire in the elevator installation zone 4, the neighboring zone 5, and the external zones 6 and 7 in the above-mentioned example, the operation of each of the first fire doors 9 and the second fire doors 11 may be controlled based on information of the presence/absence of the contamination due to the fire in the elevator installation zone 4, the neighboring zone 5, and the external zones 6 and 7. In this case, when the external zone 6 corresponding to one of the two external zones is contaminated due to the fire, the second fire door 11 is caused to perform the door closing operation to close the second communication port 10 on the external zone 6 side. When the external zone 7 corresponding to the other one of the two external zones is contaminated due to the fire, the second fire door 11 is caused to perform the door closing operation to close the second communication port 10 on the external zone 7 side. Further, when the second fire-prevention zone 5 is contaminated due to the fire, the first fire doors 9 are caused to perform the door closing operation to close the first communication port 8.

The invention claimed is:

1. A fire evacuation support system for managing an operation of an elevator based on information from a plurality of fire detectors provided on each of a plurality of floors when a fire occurs in a building, the building including, on each of the plurality of floors, an elevator installation zone in which the elevator is installed, a neighboring zone neighboring the elevator installation zone, the neighboring zone being in communication with the elevator installation zone through a first communication port, and an external zone in communication with the neighboring zone through a second communication port different from the first communication port, the first communication port being opened and closed by a first fire door, and the second communication port being opened and closed by a second fire door, the fire evacuation support system comprising an evacuation operation command section in which implementation of an evacuation operation for transporting a person left in the building to an evacuation floor is allowed for the elevator when contamination due to the fire is avoided in both the elevator installation zone and the neighboring zone, and in which the implementation of the evacuation operation is stopped when at least any one of the elevator installation zone and the neighboring zone is contaminated due to the fire.

2. A fire evacuation support system according to claim 1, further comprising a fire door control section for controlling an operation of each of the first fire door and the second fire door based on the information from each of the fire detectors.

3. A fire evacuation support system according to claim 2, wherein the fire door control section causes each of the first fire door and the second fire door provided on an operation target floor preset to correspond to a fire occurrence floor on which the fire detector has detected the contamination due to the fire, among the first fire doors and the second fire doors provided on the plurality of floors, to operate in conjunction with a detection of the fire by the fire detector on the fire occurrence floor to close each of the first communication port and the second communication port.

4. A fire door control device for controlling an operation of each of a first fire door for opening and closing a first communication port and a second fire door for opening and closing a second communication port different from the first communication port based on information from a plurality of fire detectors provided on each of a plurality of floors of a building when a fire occurs in the building including, on each of the plurality of floors, an elevator installation zone in which an elevator is installed, a neighboring zone neighboring the elevator installation zone, the neighboring zone being in communication with the elevator installation zone through the first communication port, and an external zone in communication with the neighboring zone through the second communication port, wherein the fire door control device causes each of the first fire door and the second fire door provided on an operation target floor preset to correspond to a fire occurrence floor on which the fire detector has detected contamination due to the fire, among the first fire doors and the second fire doors provided on the plurality of floors, to operate in conjunction with a detection of the fire by the fire detector on the fire occurrence floor to close each of the first communication port and the second communication port.

* * * * *